United States Patent [19]

McCauley

[11] Patent Number: 4,723,866

[45] Date of Patent: Feb. 9, 1988

[54] MANHOLE COVER LOCKING BOLT CONSTRUCTION

[75] Inventor: Durham S. McCauley, Boston, N.Y.

[73] Assignee: McGard, Inc., Buffalo, N.Y.

[21] Appl. No.: 746,273

[22] Filed: Jun. 19, 1985

[51] Int. Cl.[4] ..... E02D 29/14

[52] U.S. Cl. ..... 404/25; 411/397; 411/402; 411/910

[58] Field of Search ..... 404/25; 411/374, 397, 411/402, 403, 910, 911

[56] References Cited

U.S. PATENT DOCUMENTS

| | | | |
|---|---|---|---|
| 887,591 | 5/1908 | Cook | 404/25 X |
| 1,059,326 | 4/1913 | Ackermann | 411/427 X |
| 3,874,258 | 4/1975 | Semola et al. | 81/121 R |
| 4,145,151 | 3/1979 | Helms | 404/25 |
| 4,480,513 | 11/1984 | McCauley et al. | 81/436 |

*Primary Examiner*—George A. Suchfield
*Attorney, Agent, or Firm*—Joseph P. Gastel

[57] ABSTRACT

A manhole cover locking bolt construction for locking a manhole cover to an associated frame including a bolt having a threaded shank and an externally threaded head and an endless curvilinear groove in the top of the head for receiving a key of mating configuration for threading the bolt into and out of the manhole cover frame, and a cap for threadably mounting on the externally threaded head to protect the curvilinear groove against entry of foreign matter.

11 Claims, 8 Drawing Figures

MANHOLE COVER LOCKING BOLT CONSTRUCTION

BACKGROUND OF THE INVENTION

The present invention relates to a manhole cover locking bolt.

By way of background, in the past manhole covers of certain types were secured to their associated frames by means of bolts having conventional heads which could be removed by readily available wrenches. Thus, unauthorized access was available to cable-carrying tunnels by personnel who wished to install additional cables along the route of existing cables. Unauthorized access was also available to sewers for improper dumping of toxic wastes.

SUMMARY OF THE INVENTION

It is the object of the present invention to provide a manhole cover locking bolt which can be used to lock a manhole cover to its associated frame against unauthorized removal.

Another object of the present invention is to provide a manhole cover locking bolt which can be installed and removed by the use of a proper key and, further, which is protected against collecting dirt and debris which could interfere with its installation and removal. Other objects and attendant advantages of the present invention will readily be perceived hereafter.

The present invention relates to a manhole cover locking bolt comprising a shank, first threads on said shank, a head affixed to said shank, second threads on the outer periphery of said head, a top on the opposite side of said head from said shank, and a curvilinear groove in said top of said head for receiving a mating key.

The present invention also relates to an improvement to a manhole cover mounted in a frame having a threaded bolt-receiving bore therein with a first depresison in said frame and a second depression on said manhole cover proximate said bolt-receiving bore for receiving the head of a bolt, the improvement comprising a manhole cover locking bolt comprising a shank, first threads on said shank for mating engagement with said threaded bolt-receiving bore in said frame, a head affixed to said shank for entry into said adjacent depressions, a top on said head, second threads on said head, and a curvilinear groove in said top of said head for receiving a mating key.

The various aspects of the present invention will be more fully understood when the following portions of the specification are read in conjunction with the accompanying drawings wherein:

DESCRIPTION OF THE PREFERRED EMBODIMENTS

The improved manhole cover bolt 10 is for the purpose of locking a manhole cover 11 to its associated frame 12 which is suitably anchored in the surrounding area 13, which may be a roadway or a sidewalk or any other structure on which the frame 12 can be mounted.

Figure 1:
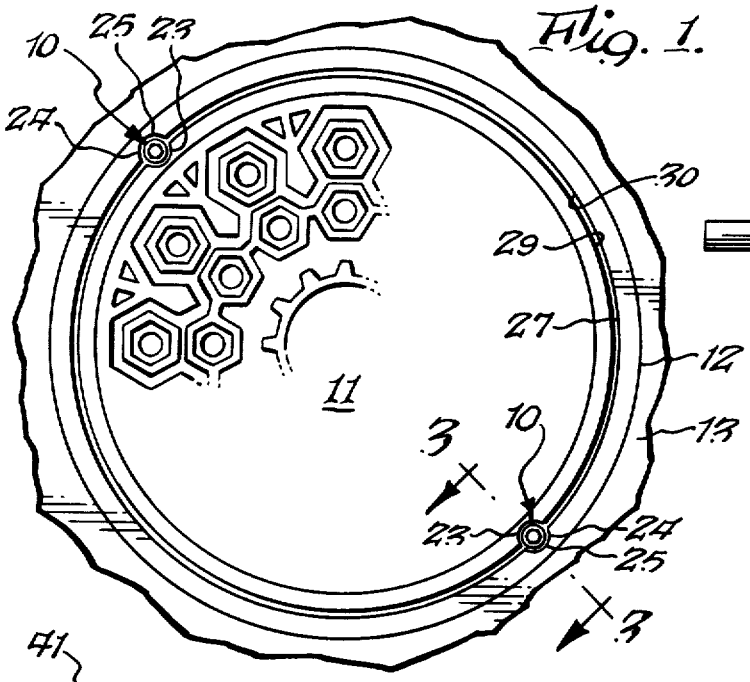
FIG. 1 is a fragmentary plan view of a manhole cover secured to its associated frame by means of the improved locking bolts of the present invention.
Figure 6:
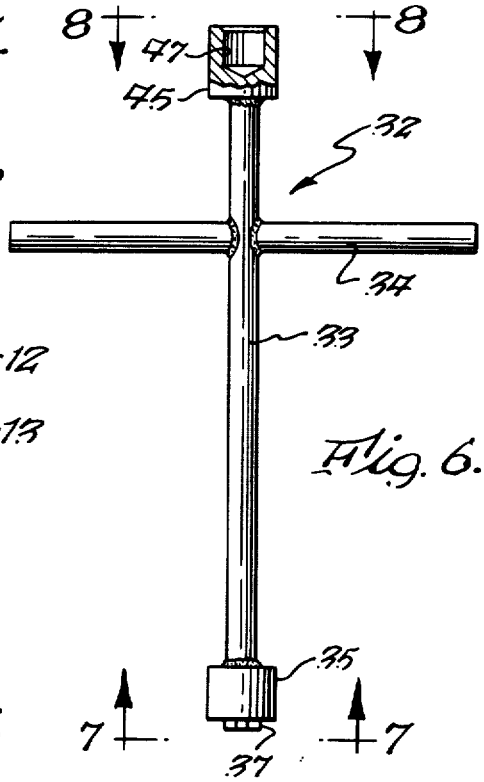
FIG. 6 is a side elevational view, partially broken away, showing in reduced scale, a wrench which carries a socket for mounting the protective cap on the head of the bolt and also carries a key for mating engagement with the curvilinear groove in the head of the bolt.
Figure 5:
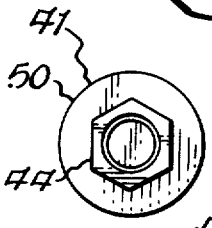
FIG. 5 is a view taken in the direction of arrows 5—5 of FIG. 2 and showing the configuration of the protective cap in plan.
Figure 8:
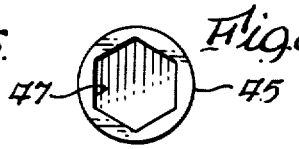
FIG. 8 is a view taken in the direction of arrows 8—8 of FIG. 6 and showing the configuration of the non-circular socket for mating engagement with a nut-like protuberance on the cap.
Figure 2:
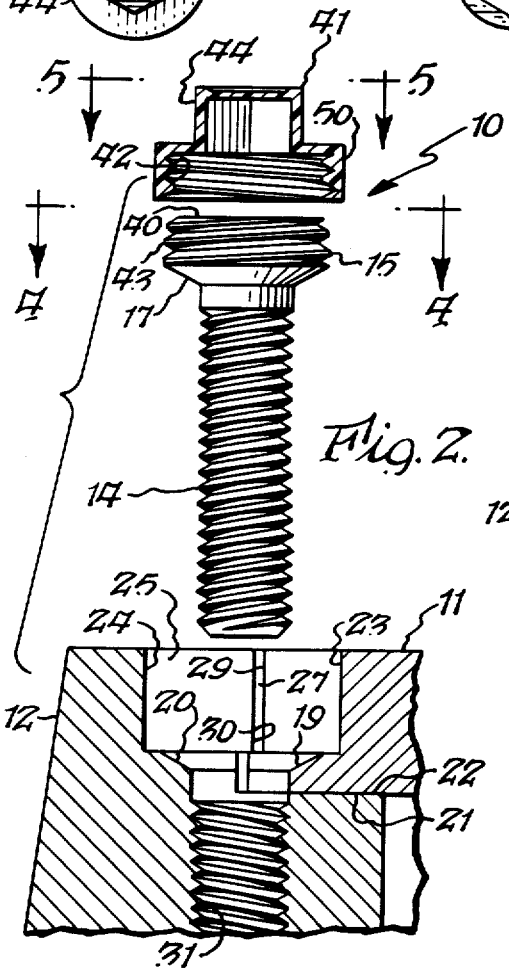
FIG. 2 is an exploded view of the manhole cover bolt and its associated protective cap shown in relation to the manhole cover mounted on its associated frame.
Figure 7:
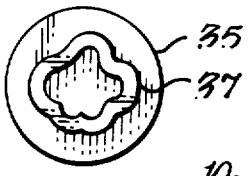
FIG. 7 is a view taken in the direction of arrows 7—7 of FIG. 6 and showing the curvilinear ridge in the key which mates with the curvilinear groove in the top of the head of the bolt.
Figure 4:
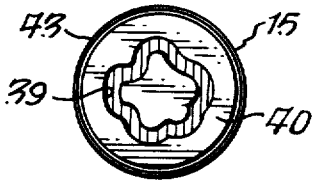
FIG. 4 is a view taken in the direction of arrows 4—4 of FIG. 2 and showing the endless curvilinear groove in the top of the head of the bolt.

The manhole cover bolt 10, which is fabricated of hardened chiselproof steel, includes an elongated threaded shank 14 and a head 15 formed integrally therewith. An annular frustoconical bevel or lip 17 is formed on the underside of head 15 for complementary mating engagement with an arcuate bevel 19 or manhole cover 11 and arcuate bevel or lip 20 on frame 12 when cover 11 is properly aligned with frame 12. The cover 11 is mounted on frame 12, the outer annular portion 21 of cover 11 rests on inner annular portion 22 of frame 12. In addition, a depression 23 in cover 11 is in alignment with a depression 24 in frame 12 to define an essentially cylindrical opening 25 for receiving head 15 of bolt 10. As can be seen from FIGS. 1 and 2, a space 27 exists between the outer edge 29 of cover 11 and the inner edge 30 of frame 12.

In order to lock manhole cover 11 to its associated frame 12, the shank 14 of bolt 10 is threaded into the tapped hole 31 in frame 12. The threading is effected by the use of wrench 32 having a body 33 and a handle 34. At one end of body 33 is a head 35 having an endless curvilinear groove 37 in the top 40 of bolt head 15. A ridge and groove of this type are fully described in U.S. Pat. Nos. 3,241,408 and 4,480,513 and other than in the present combination do not form any part of the present invention. Bolt 10 is turned by the use of wrench 32 until its annular frustoconical undersurface 17 seats on adjacent surfaces 19 and 20 of manhole cover 11 and frame 12, respectively. Surfaces 19 and 20 define a substantially annular seat which is split by space 27 at substantially diametrically opposite sides thereof. As can be seen from FIG. 1, two bolts 10 are used at diametrically opposite sides of manhole cover 11 to firmly lock it to its associated frame. Bolts 10 cannot be unscrewed without the use of a proper key comprising curvilinear ridge 37.

Since the manhole cover is on the ground, the curvilinear groove 39 can fill up with dirt, ice and other debris, which in turn, could prevent the ridge 37 from entering the groove 39 to a sufficient extent to unscrew bolt 10. Accordingly, a cap 41 is provided which has internal threads 42 for mating engagement with external threads 43 on bolt head 15. Cap 41 also includes a hexagonal nut-like protuberance 44, which may be of any other suitable configuration. Wrench 32 includes a socket 45 having a cavity 47 for mating engagement with non-circular protuberance 44. Therefore, by the use of wrench 32, cap 41 can be screwed into tight locking engagement with bolt head 15.

Figure 3:
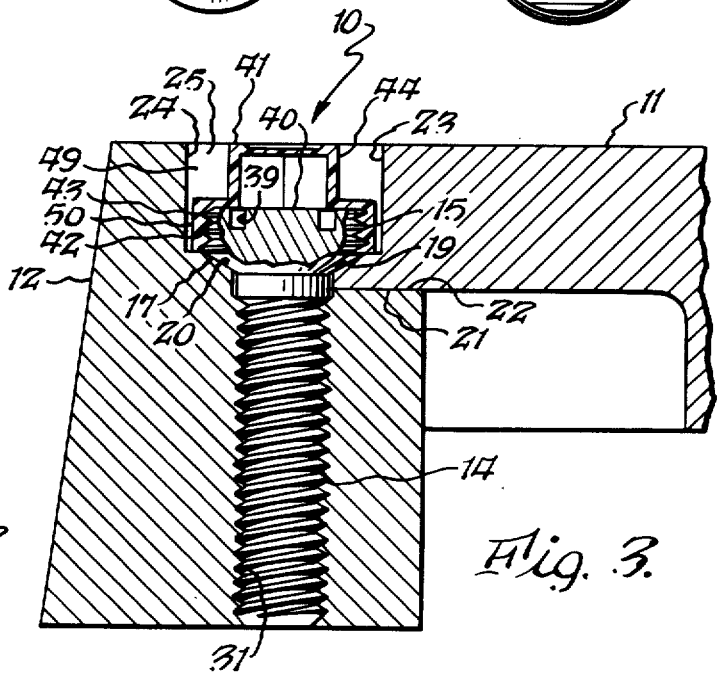
FIG. 3 is a fragmentary cross sectional view taken substantially along line 3—3 of FIG. 1 and showing the bolt in locking relationship to the manhole cover with the protective cap mounted on the head of the bolt.

There is a clearance space 49 (FIG. 3) between protuberance 44 and the adjacent parts of frame 12 and cover 11 to permit entry of socket 45. Also, as can be seen from FIG. 3, there is a sufficient clearance around threaded bolt head 15 to receive the side wall 50 of cap 41, but this clearance is not sufficiently large to receive a conventional socket wrench. The wrench 32 is used to remove cap 41 and unscrew bolt 10 by following the steps in reverse to those described above for installing bolts 10.

The relative diameters of head 35 which carries key 37 and cylindrical opening 25 which receives bolt head 15 are such that opening 25 acts as a guide to center head 35 to thereby facilitate the alignment of ridge 37 with groove 39. More specifically, all that is necessary to cause ridge 37 to enter groove 39 is to insert body 35 into cylindrical opening 25 and turn wrench 32 until ridge 37 falls into groove 39.

While preferred embodiments of the present invention have been disclosed, it will be appreciated that the present invention is not limited thereto but may be otherwise embodied within the scope of the following claims.

What is claimed is:

1. A manhole cover locking bolt for locking a manhole cover against removal from its associated frame comprising a shank, first thread means on said shank for reception in a tapped bore in said frame, head means affixed to said shank for bearing on a lip on the manhole cover when said shank is screwed into said tapped bore to thereby prevent said manhole cover from being lifted out of said frame, second thread means on the outer periphery of said head for receiving a mating cap, a top on the opposite side of said head from said shank, and curvilinear groove means in said top of said head for receiving a mating key.

2. A manhole cover locking bolt as set forth in claim 1 including a cap which is mountable on and removable from said head, internal thread means on said cap for mating engagement with said second thread means for mounting said cap on said head to protect said curvilinear groove means against entry of solid foreign matter and for removing said cap from said head when access is to be had to said curvilinear groove by said mating key.

3. A manhole cover locking bolt as set forth in claim 2 including non-circular protuberance means on said cap for receiving a wrench in mating relationship for threading said cap onto said head.

4. A manhole cover locking bolt as set forth in claim 3 including wrench means, a key mounted on said wrench means for mating with said curvilinear groove means, and a socket mounted on said wrench means for mating engagement with said non-circular protuberance means.

5. In a manhole cover mounted in a frame having a threaded bolt-receiving bore therein, an upper end and a lower end in said bolt-receiving bore, a first depression in said frame proximate said upper end of said bolt-receiving bore, a second depression on said manhole cover adjacent said first depression, and lip means on said manhole cover at the base of said second depression, the improvement comprising a manhole cover locking bolt comprising a shank, first thread means on said shank for mating engagement with said threaded bolt-receiving bore in said frame, a head affixed to said shank for entry into said adjacent first and second depressions, an undersurface on said head for bearing on said lip means, a top on said head, curvilinear groove means in said top of said head for receiving a mating key, and second thread means on the outer periphery of said head for receiving a cap for protecting said curvilinear groove means against the entry of solid foreign matter.

6. In a manhole cover mounted in a frame as set forth in claim 5 including a cap, internal thread means on said cap for mating engagement with said second thread means for mounting said cap on said head to protect said curvilinear groove means against said entry of solid foreign matter and for removing said cap to permit access to said curvilinear groove means.

7. In a manhole cover mounted in frame as set forth in claim 5 including non-circular protuberance means on said cap for receiving a wrench for installing and removing said cap on said head.

8. In a manhole cover mounted in a frame as set forth in claim 5 wherein said frame includes second lip means proximate said lip means, and wherein said undersurface also bears on said second lip means.

9. In a manhole cover mounted in a frame as set forth in claim 5 wherein said frame and said manhole cover have surfaces defining said first and second depressions, and wherein there is a relatively small clearance between said head and said surfaces which is sufficient to permit entry of a socket of a conventional socket wrench.

10. In a manhole cover mounted in a frame as set forth in claim 7 including wrench having a key with a ridge for mating engagement with said curvilinear groove means and also having a socket for mating engagement with said protuberance.

11. In a manhole cover mounted in a frame as set forth in claim 5 including wrench means having a key with a curvilinear ridge for mating engagement with said curvilinear groove means, and wherein said adjacent first and second depressions form a substantially cylindrical bore of a first diameter, and a head on said wrench of a second diameter for mounting said curvilinear ridge, said second diameter being sufficiently close to said first diameter so as to center said head relative to said curvilinear groove means to thereby facilitate entry of said curvilinear ridge therein.

* * * * *

UNITED STATES PATENT AND TRADEMARK OFFICE

CERTIFICATE OF CORRECTION

PATENT NO. : 4,723,866

DATED : February 9, 1988

INVENTOR(S) : Durham S. McCauley

It is certified that error appears in the above-identified patent and that said Letters Patent is hereby corrected as shown below:

Column 2, line 34, change "or" to --on--;

line 36, change "The" to --When--;

line 50, change "groove" to --ridge--, and after "37" insert --for mating engagement with an endless curvilinear groove 39--.

Column 4, line 42 (claim 9), change "sufficient" to --insufficient--.

Signed and Sealed this

Fourteenth Day of June, 1988

*Attest:*

*Attesting Officer*

DONALD J. QUIGG

*Commissioner of Patents and Trademarks*